US006228320B1

(12) United States Patent
Nagati et al.

(10) Patent No.: US 6,228,320 B1
(45) Date of Patent: May 8, 2001

(54) TILTABLE CONVERTER

(75) Inventors: Rashed Nagati, Mars, PA (US); Bernhard Enkner, Linz (AT); Rudolf Gruber, Prambachkirchen (AT); Guenther Staudinger, Gmunden (AT); Thomas Daum, Moon, PA (US)

(73) Assignee: Voest-Alpine Industries, Inc., Canonsburg, PA (US)

( * ) Notice: Subject to any disclaimer, the term of this patent is extended or adjusted under 35 U.S.C. 154(b) by 0 days.

(21) Appl. No.: 09/400,333

(22) Filed: Sep. 21, 1999

(51) Int. Cl.[7] ..... C21C 5/50
(52) U.S. Cl. ..... 266/246; 266/245
(58) Field of Search ..... 266/244, 245, 266/246

(56) References Cited

U.S. PATENT DOCUMENTS

| | | | | |
|---|---|---|---|---|
| 3,561,744 | * | 2/1971 | Altman | 266/246 |
| 4,061,318 | * | 12/1977 | Fisher | 266/246 |
| 5,364,079 | | 11/1994 | Gruber et al. | 266/246 |

OTHER PUBLICATIONS

"The VAI–CON Link Suspension System for LD/BOF Converters" Dec. 1995.

* cited by examiner

*Primary Examiner*—Scott Kastler
(74) *Attorney, Agent, or Firm*—Webb Ziesenheim Logsdon Orkin & Hanson, P.C.

(57) ABSTRACT

A converter is provided having a converter vessel carried on a trunnion ring by a mounting system. The mounting system has six mounting elements including a plurality of mounting elements incorporating pendulum rods and one mounting element incorporating a stabilizer device. Each pendulum rod is connected at one end to the trunnion ring and at the other end to the converter vessel. In a preferred embodiment of the invention, the mounting system includes three longitudinal mounting devices each having a longitudinal pendulum rod; two transverse mounting devices each having a transverse pendulum rod; and a stabilizer device having a pair of spaced stabilizer blocks connected to the trunnion ring and a pair of stabilizer elements connected to the converter vessel. The longitudinal mounting devices and the stabilizer device are located below the trunnion ring and the transverse mounting devices are located above the trunnion ring when the converter vessel is in an upright position. A statically determinate mounting of the converter vessel in the trunnion ring is thus accomplished with six mounting elements including five pendulum rods and one stabilizer device.

21 Claims, 3 Drawing Sheets

TILTABLE CONVERTER

BACKGROUND OF THE INVENTION

1. Field of the Invention

The invention relates generally to a tiltable converter having a trunnion ring surrounding a converter vessel, the converter vessel being supported on the trunnion ring by a mounting system.

2. Description of the Currently Available Technology

Tiltable converters are known in the art. The support system must enable the converter vessel to thermally expand and contract unimpeded in the radial and longitudinal direction. The converter vessel is known to grow globally (material creep), to locally distort and change its shape when subjected to elevated temperature during operation. Such changes in form could affect the loads imposed on the support system members unless the system is statically determinate. This determinacy is desirable to better enable designing the members to the loads applied on them.

A statically determinate tiltable converter is disclosed in U.S. Pat. No. 5,364,079, which is herein incorporated by reference. In this tiltable converter, the converter vessel is connected to the trunnion ring by six or seven pendulum rods, with spherical plain bearings located at each end of each rod. The seven rod design, under conditions of converter vessel distortion, would be rendered statically indeterminate, whereas the six rod design, with three Alongitudinal@ pendulum rods extending substantially parallel to a longitudinal axis of the converter vessel and three Atansverse@ pendulum rods extending substantially parallel to the plane of the trunnion ring would be statically determinate. However, additional improvements could be made to further enhance the design and/or performance of this tiltable converter.

SUMMARY OF THE INVENTION

Whereas U.S. Pat. No. 5,364,079 specifically teaches that all of the pendulum rods are located below the trunnion ring, the present invention teaches relocating the transverse pendulum rods, especially those oriented in the neighborhood of the rotational axis of the converter, above the trunnion ring to provide a multiplicity of design and operational advantages. The added gains in the arrangement of the transverse pendulum rods above the trunnion ring are most applicable to those converters which must necessarily have openings for process gas conduits and piping, of substantial diameters, which need to circle unhindered around the converter vessel before they can be directed to the converter bottom. Also, the relocation of the transverse pendulum rods above the trunnion ring removes them from an area in the converter exposed to heat from hot accumulating slag and known for potential break-outs by molten contents inside the converter in case of refractory failure. Placing the transverse pendulum rods above the trunnion ring additionally assists in balancing the converter by raising its center of gravity closer to the axis of rotation, thus lowering the torque requirement to tilt the converter.

The present invention provides a converter which possesses the aforementioned advantages in addition to those advantages disclosed in U.S. Pat. No. 5,364,079. Relocation of the transverse pendulum rods can be achieved without a major increase in their size or the general design of the mounting system. Because a statically determinate mounting system is desirable, it becomes necessary to consider the six link system comprising three longitudinal and three transverse pendulum rods. Since the same equations apply for determining the loads in the link system when the transverse links are below the trunnion ring as when the transverse links are above the trunnion ring, the present invention teaches that there is no compelling reason to follow the dictates of U.S. Pat. No. 5,364,079 which teaches placing the transverse links exclusively below the trunnion ring. Specifically the static determinacy is not violated by placing the transverse pendulum rods above the trunnion ring. As will be understood by one knowledgeable in the art, one transverse link system, particularly that which is oriented substantially in the direction of the axis of rotation, may be retained to provide lateral stability to the converter vessel within the trunnion ring. However, an alternate manner of providing the needed lateral support in accordance with the invention is by providing a stabilizer which restricts the lateral motion of the converter vessel with respect to the trunnion ring in the direction substantially parallel to the axis of rotation, while allowing the converter vessel to thermally expand in the radial and longitudinal directions. This embodiment will, therefore, provide a six component mounting system comprising five links and one stabilizer. These six components provide a statically determinate system.

A preferred embodiment of a converter incorporating features of the invention comprises a converter vessel carried on a trunnion ring by a mounting system. The mounting system includes six mounting components or elements which include a plurality of, e.g., five, mounting elements incorporating pendulum rods and one mounting element comprising a stabilizer device. Each pendulum rod is connected at one end to the trunnion ring and at the other end to the converter vessel, preferably by spherical bearings. In a preferred embodiment of the invention, the mounting system comprises six elements including three first mounting devices, each having a first pendulum rod; two second mounting devices, each having a second pendulum rod; and a stabilizer device. The first mounting devices and the stabilizer device are preferably located below or on the lower side of the trunnion ring and the second mounting devices are preferably located above or on the upper side of the trunnion ring when the converter vessel is in an upright position. A statically determinate mounting of the converter vessel in the trunnion ring is thus accomplished with five pendulum rods and one stabilizer device.

A complete understanding of the invention will be obtained from the following description when taken in connection with the accompanying drawing figures, wherein like reference characters identify like parts throughout.

DESCRIPTION OF THE PREFERRED EMBODIMENTS

Figure 1:
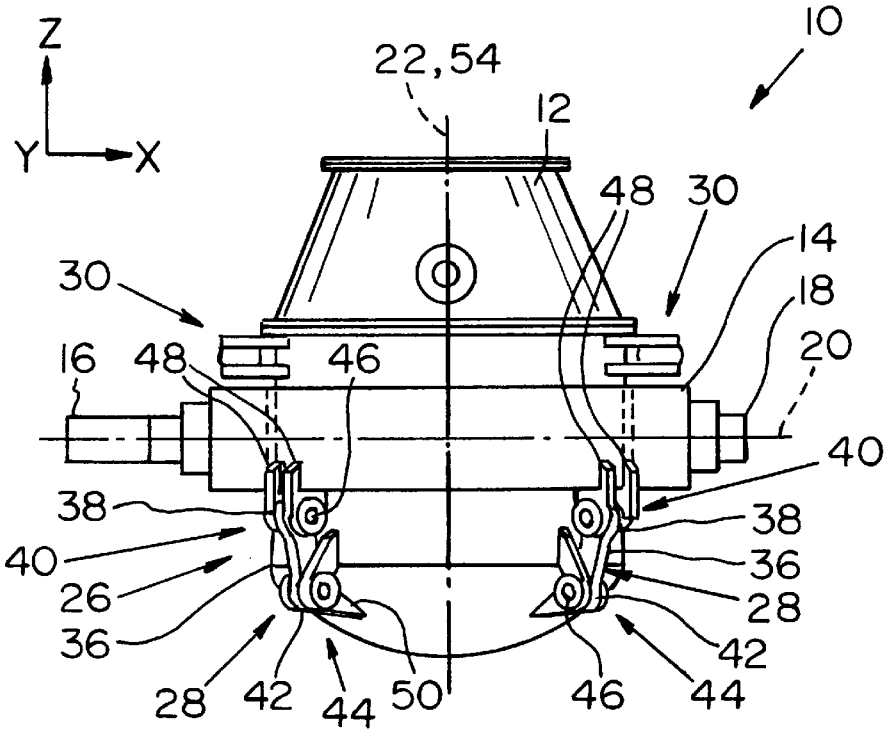
FIG. 1 is a front view of a converter incorporating features of the invention.

For purposes of the description herein, the terms Aupper@, Alower@, Aabove@, Abelow@, Avertical@, Ahorizontal@, Aleft@, Aright@, Alongitudinal@, Atransverse@, Aparallel@, Aperpendicular@ and similar spatial or directional terms shall relate to the invention as it is oriented in the drawing figures. However, it is to be understood that the invention may assume various alternative orientations without departing from the inventive concept.

A converter incorporating features of the invention is generally designated 10 in FIGS. 1–5. As shown in FIG. 1, the converter 10 includes a hollow converter vessel 12 surrounded and/or supported by a closed trunnion ring 14, which may have a box-type or rectangular cross section. The trunnion ring 14 is tiltably mounted in supporting bearings (not shown) by two opposed carrying trunnions 16 and 18. At least one of the carrying trunnions 16 and 18 is connected in conventional manner with a tilting drive (not shown) to tilt the converter around a tilting axis 20 running through the trunnions 16 and 18. The tilting axis 20 is substantially perpendicular to the longitudinal axis 22 of the converter vessel 12.

The converter vessel 12 is carried on the trunnion ring 14 by a mounting system 26. As will be described in more detail hereinbelow, the mounting system includes a plurality, preferably three, first or longitudinal mounting devices 28, a plurality, preferably two, second or transverse mounting devices 30 and a stabilizer device 32. As will be described further below, the transverse mounting devices 30 extend substantially parallel to the plane of the trunnion ring 14.

As used herein, the terms Alongitudinal@ or Alongitudinal direction@ refer to the direction which is parallel or substantially parallel to the vertical or longitudinal axis 22 of the converter vessel 12 when the converter vessel 12 is in an upright position, as shown in FIG. 1. Looking first at the longitudinal mounting devices 28, as shown in FIGS. 1, 2, 4 and 5, each longitudinal mounting device 28 includes a first or longitudinal pendulum rod 36 to connect the converter vessel 12 to the trunnion ring 14. Each longitudinal pendulum rod 36 is located below the trunnion ring 14 when the converter vessel 12 is in the upright position shown in FIG. 1. Each longitudinal pendulum rod 36 is metal, preferably steel or similar metal.

Figure 2:
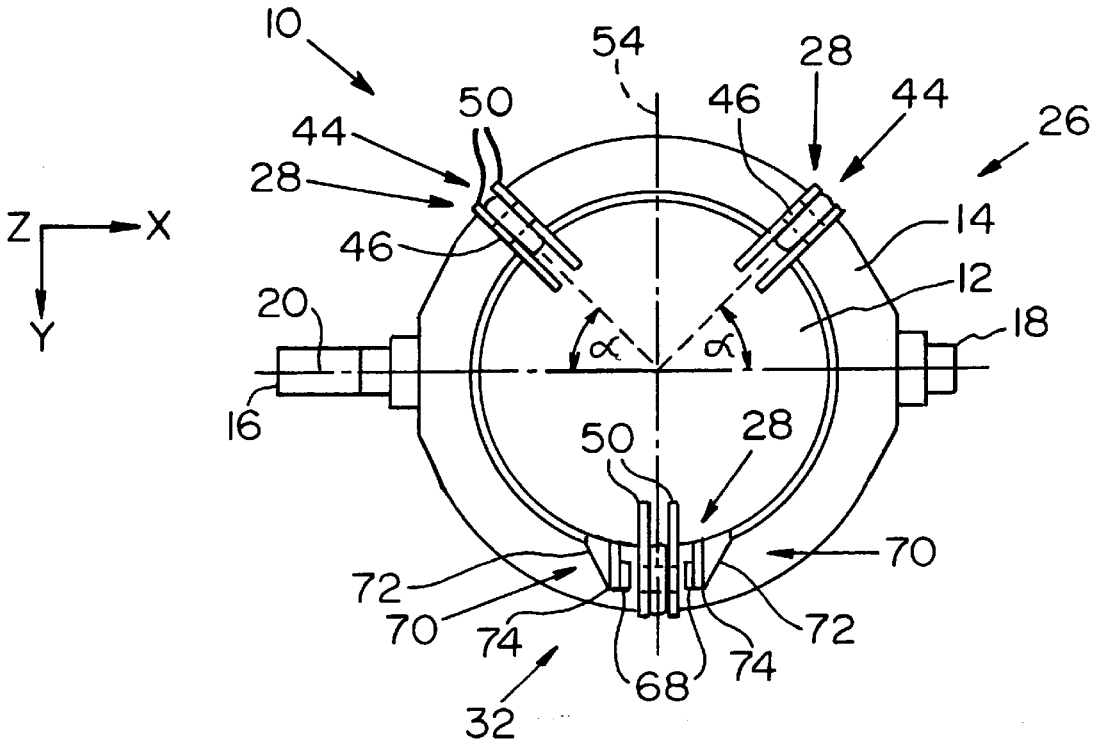
FIG. 2 is a bottom view of the converter of FIG. 1.

One end, e.g., the upper end 38, of each longitudinal pendulum rod 36 is connected to the trunnion ring 14 by a spherical bearing 40 and the other end, e.g., lower end 42, of the longitudinal pendulum rod 36 is connected with the converter vessel 12 by another spherical bearing 44. Each spherical bearing 40,44 comprises a pin 46 passing through the longitudinal pendulum rod 36 and mounted on the pendulum rod via the spherical bearing 40,44. The ends of the pin 46 protrude laterally and are supported by an upper support assembly having a pair of spaced support lugs 48 fastened to the trunnion ring 14 and a lower support assembly having a pair of spaced support lugs 50 fastened to the converter vessel 12. The lower support lugs 50 are preferably welded to the converter vessel 12. The upper support lugs 40 are preferably welded to the trunnion ring 14. The longitudinal pendulum rods 36 serve to absorb the forces of the converter vessel 12 in its upright position, e.g., block translation in the Z direction and compensate for rotation around the X and Y axes. As shown in FIGS. 1 and 2, the longitudinal mounting devices 28 are positioned arcuately around the lower portion of the converter vessel 12. For ease of discussion, the associated X, Y and Z axes are indicated in each drawing figure.

As shown in FIG. 2, a transverse plane 54 extends substantially perpendicularly to the tilting axis 20 and preferably intersects the longitudinal axis of the converter vessel 12. One of the longitudinal mounting devices 28 is preferably positioned on or along the transverse plane 54. The other two longitudinal mounting devices 28 are positioned at an angle $\alpha$ of about 25–50 degrees from the tilting axis 20.

Figure 3:
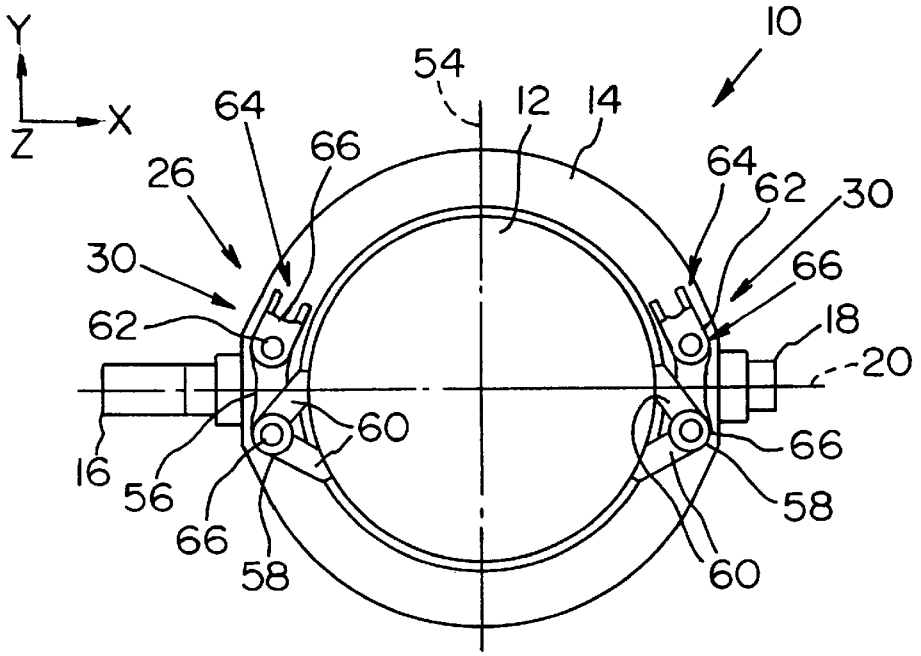
FIG. 3 is a top view of the converter of FIG. 1.
Figure 4:
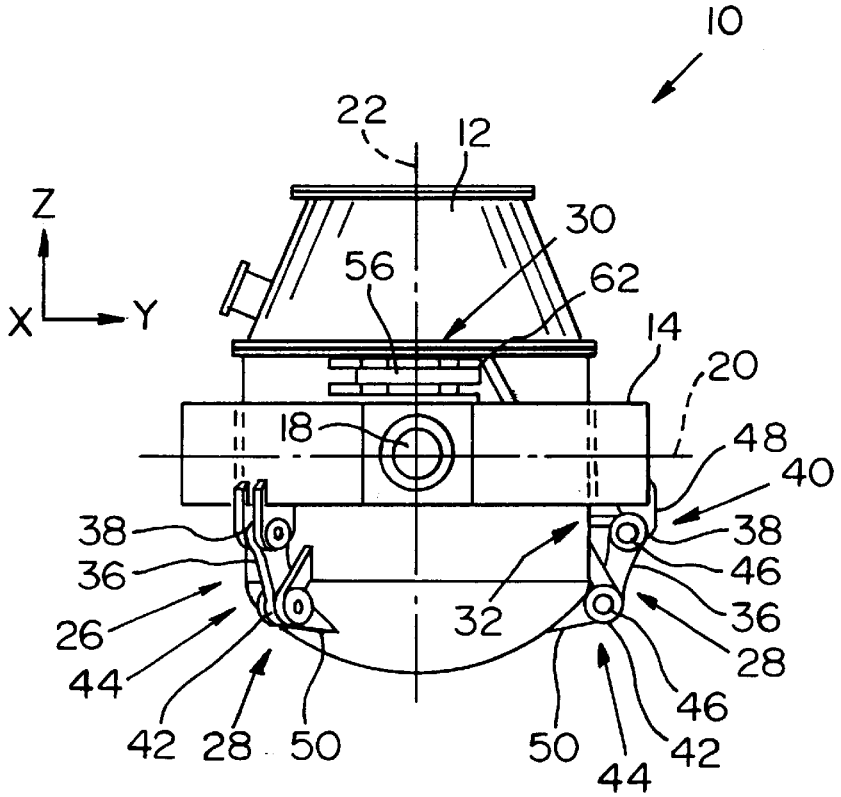
FIG. 4 is a side view of the converter of FIG. 1 rotated 90 degrees to the left.

As shown in FIGS. 1 and 3, the two transverse mounting devices 30 each include a transverse pendulum rod 56 having one end 58 connected to the converter vessel 12 by a first mounting assembly having a pair of spaced mounting lugs 60 and the other end 62 connected to the trunnion ring by a second mounting assembly having one or more mounting lug(s) 64. A spherical bearing 66 is located at each end 58,62 of the transverse pendulum rod 56 in similar manner as described above with respect to the longitudinal pendulum rods 36 and as described in U.S. Pat. No. 5,364,079. The transverse mounting devices 30 compensate for translation of the converter vessel 12 in the Y direction and rotation in the Z direction. The two transverse mounting devices 30 are preferably arranged above the trunnion ring 14 and more preferably above or near the trunnions 16 and 18. Each transverse pendulum rod 56 extends parallel or substantially parallel to the transverse plane 54 and at substantially a right angle to the tilting axis 20 and/or longitudinal axis 22 of the converter vessel 12.

Figure 5:
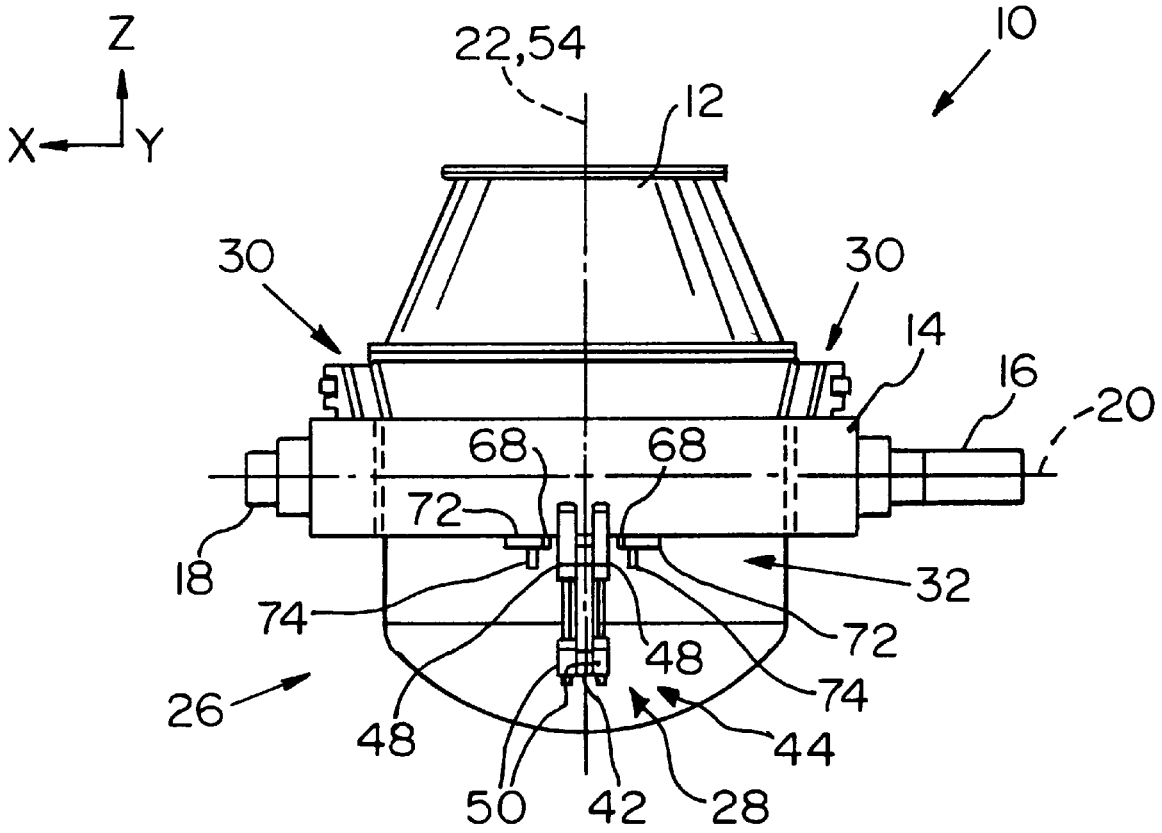
FIG. 5 is a side view of the converter of FIG. 4 rotated 90 degrees to the left.

As shown in FIGS. 2 and 5, the stabilizer device 32 comprises a pair of spaced, stabilizer blocks 68 connected, e.g., welded, to the lower side of the trunnion ring 14. A stabilizer element 70 is located adjacent, e.g., outboard, of each stabilizer block 68 and each stabilizer element 70 is connected, e.g., welded, to the converter vessel 12. The stabilizer element 70 may be a single, unitary piece or may be an angled or substantially AT@ shaped piece with an upper member 72 extending outwardly from the converter vessel 12 and supported by a lower member 74. However, the exact shapes of the stabilizer blocks 68 and stabilizer element 70 are not critical to the invention. As shown in FIG. 5, the stabilizer device 32 limits shifting of the converter vessel 12 in the X direction, e.g., by limiting movement of the converter vessel 12 through contact between the stabilizer blocks 68 and the stabilizer elements 70.

The mounting system of the present invention provides a statically determinate support for the converter vessel 12 while utilizing only six mounting elements, i.e., five pendulum rods (three longitudinal pendulum rods 36 and two transverse pendulum rods 56) and one stabilizer device 32. The direction of force for the introduction of forces into the converter vessel 12 is precisely determined and does not change with the tilting position. Further, with the transverse mounting devices 30 located above the trunnion ring 14, more surface area of the converter vessel 12 is available below the trunnion ring 14 into which piping may be connected to carry process media into the converter vessel 12. Additionally, positioning the transverse mounting devices 30 above the trunnion ring 14 raises the center of gravity of the converter vessel 12 and hence decreases the torque required to tilt the converter vessel 12.

It will be readily appreciated by those skilled in the art that modifications may be made to the invention without departing from the concepts disclosed in the foregoing description. For example, although not preferred, a pendulum rod extending approximately parallel to a plane of the trunnion ring and approximately parallel to the tilting axis could be used in place of the stabilizer device in the practice of the invention. Such modifications are to be considered as included within the following claims unless the claims, by their language, expressly state otherwise. Accordingly, the particular embodiment described in detail herein is illustrative only and is not limiting to the scope of the invention, which is to be given the full breadth of the appended claims and any and all equivalents thereof.

What is claimed is:

1. A statically determinate tiltable converter, comprising:

a converter vessel;

a trunnion ring; and a mounting system, wherein the converter vessel is connected to the trunnion ring by the mounting system and wherein the mounting system includes:

a plurality of first mounting devices, each first mounting device including a pendulum rod having one end connected to the converter vessel and the other end connected to the trunnion ring;

a plurality of second mounting devices, each second mounting device including a pendulum rod having one end connected to the converter vessel and the other end connected to the trunnion ring; and a stabilizer device configured to limit movement of the converter vessel with respect to the trunnion ring, wherein the first mounting devices are located below the trunnion ring and the second mounting devices are located above the trunnion ring when the converter vessel is in an upright position.

2. The converter as claimed in claim 1, wherein the converter vessel includes a longitudinal axis and the pendulum rods of the first mounting devices extend substantially parallel to the longitudinal axis.

3. The converter as claimed in claim 2, wherein the converter includes a tilting axis and the pendulum rods of the second mounting devices extend substantially perpendicular to the longitudinal axis and substantially perpendicular to the tilting axis.

4. The converter as claimed in claim 1, wherein the stabilizer device is configured to limit movement of the converter vessel by contact between at least one stabilizer block connected to the trunnion ring and at least one stabilizer element connected to the converter vessel.

5. The converter as claimed in claim 1, wherein the stabilizer device includes a pair of spaced stabilizer blocks connected to the trunnion ring and a stabilizer member located adjacent each block and connected to the converter vessel.

6. The converter as claimed in claim 2, including a transverse plane extending substantially perpendicular to the tilting axis and substantially parallel to the longitudinal axis, wherein one of the first mounting devices is located on the transverse plane.

7. The converter as claimed in claim 6, wherein the stabilizer device includes a pair of spaced stabilizer blocks connected to the trunnion ring, with one stabilizer block located on each side of the first mounting device located on the transverse plane, and further includes a stabilizer element located adjacent each stabilizer block and connected to the converter vessel.

8. The converter as claimed in claim 1, wherein the mounting system comprises six mounting elements including three first mounting devices, two second mounting devices and one stabilizer device.

9. A statically determinate tiltable converter, comprising:

a converter vessel having a longitudinal axis;

a trunnion ring; and a mounting system configured to attach the converter vessel to the trunnion ring, wherein the mounting system includes:

a plurality of first mounting devices, each first mounting device having a pendulum rod extending substantially parallel to the longitudinal axis of the converter vessel;

a plurality of second mounting devices, each second mounting device having a pendulum rod extending substantially perpendicular to the longitudinal axis of the converter vessel, wherein the second mounting devices are located above the trunnion ring; and a stabilizer device, the stabilizer device including at least one stabilizer block connected to the trunnion ring and at least one stabilizer element connected to the converter vessel and located adjacent the stabilizer block.

10. The converter as claimed in claim 9, including three first mounting devices.

11. The converter as claimed in claim 9, wherein the stabilizer device includes a pair of spaced stabilizer blocks connected to the trunnion ring and a pair of stabilizer elements connected to the converter vessel, with one stabilizer element located adjacent each stabilizer block such that movement of the converter vessel with respect to the trunnion ring is limited by contact between the stabilizer blocks and the stabilizer elements.

12. The converter as claimed in claim 9, wherein each first mounting device includes a first support assembly connected to the converter vessel, a second support assembly connected to the trunnion ring and a pendulum rod extending between and connected to the first and second support lug assemblies.

13. The converter as claimed in claim 12, wherein the pendulum rod is connected to the support assemblies by spherical bearings.

14. The converter as claimed in claim 9, wherein the first mounting devices are located below the trunnion ring.

15. The converter as claimed in claim 9, wherein the stabilizer device is located below the trunnion ring.

16. The converter as claimed in claim 9, wherein the trunnion ring includes a pair of opposed trunnions defining a tilting axis, wherein a transverse plane extends substantially perpendicular to the tilting axis, and wherein one of the first mounting devices is located along the transverse plane.

17. The converter as claimed in claim 16, wherein the stabilizer device includes a pair of stabilizer blocks connected to the trunnion ring and a pair of stabilizer elements connected to the converter vessel, wherein one stabilizer block is located on each side of the first mounting device located along the transverse plane and one stabilizer element is located adjacent each stabilizer block.

18. A statically determinate, tiltable converter, comprising:

a converter vessel having a longitudinal axis and an x-direction;

a trunnion ring having a pair of opposed trunnions defining a tilting axis, with a transverse plane extending through the longitudinal axis and substantially perpendicular to the tilting axis; and a mounting system connecting the converter vessel to the trunnion ring, the mounting system comprising six mounting elements including:

three first mounting devices located below the trunnion ring, each first mounting device including a first support assembly connected to the converter vessel, a second support assembly connected to the trunnion ring, and a pendulum rod extending between and connected to the first and second support assemblies by spherical bearings, wherein one of the first mounting devices is located along the transverse plane and wherein the pendulum rod of each first mounting device extends substantially parallel to the longitudinal axis;

two second mounting devices located above the trunnion ring, each second mounting device including a first mounting assembly connected to the converter vessel and a second mounting assembly connected to the trunnion ring, with a pendulum rod extending between and connected to the first and second mounting assemblies by spherical bearings, wherein one second mounting device is located adjacent each trunnion and wherein the pendulum rod of each second mounting device extends substantially perpendicular to the longitudinal axis and substantially perpendicular to the tilting axis; and a stabilizer device, the stabilizer device including a pair of spaced stabilizer blocks connected to the trunnion ring and a pair of stabilizer elements connected to the converter vessel, wherein one of the stabilizer blocks is located on each side of the first mounting device located along the transverse plane, and wherein one stabilizer element is located adjacent each stabilizer block such that movement of the converter vessel in the x-direction with respect to the trunnion ring is limited by contact between the stabilizer blocks with the stabilizer elements.

19. A statically determinate tiltable converter, comprising:

a converter vessel;

a trunnion ring; and a mounting system, wherein the converter vessel is connected to the trunnion ring by the mounting system, and wherein the mounting system includes:

at least one first mounting device located below the trunnion ring;

at least one second mounting device located above the trunnion ring; and a stabilizer device configured to limit movement of the converter vessel with respect to the trunnion ring.

20. The converter as claimed in claim 19, wherein the first and second mounting devices include pendulum rods.

21. The converter as claimed in claim 19, wherein the stabilizer device comprises at least one stabilizer block connected to the trunnion ring and at least one stabilizer element connected to the converter vessel.

* * * * *